US008331813B2

(12) United States Patent
Ozeki

(10) Patent No.: US 8,331,813 B2
(45) Date of Patent: Dec. 11, 2012

(54) IMAGE FORMING APPARATUS HAVING SPEED DIFFERENCE CONTROL

(75) Inventor: Fumitaka Ozeki, Tokyo (JP)

(73) Assignee: Oki Data Corporation, Tokyo (JP)

( * ) Notice: Subject to any disclaimer, the term of this patent is extended or adjusted under 35 U.S.C. 154(b) by 191 days.

(21) Appl. No.: 12/662,379

(22) Filed: Apr. 14, 2010

(65) Prior Publication Data

US 2010/0303490 A1 Dec. 2, 2010

(30) Foreign Application Priority Data

Apr. 15, 2009 (JP) ..... 2009-098806

(51) Int. Cl.
*G03G 15/00* (2006.01)
*G03G 15/01* (2006.01)

(52) U.S. Cl. ..... 399/49; 399/301

(58) Field of Classification Search ..... 399/301, 399/49, 72, 297, 298, 299, 302, 303
See application file for complete search history.

(56) References Cited

U.S. PATENT DOCUMENTS

| | | | |
|---|---|---|---|
| 2004/0240894 | A1 | 12/2004 | Tomita et al. |
| 2005/0207799 | A1 | 9/2005 | Ebara |
| 2006/0062617 | A1 | 3/2006 | Yamasaki |
| 2008/0292335 | A1 | 11/2008 | Kubota et al. |

FOREIGN PATENT DOCUMENTS

| | | | |
|---|---|---|---|
| JP | 6-27776 | | 2/1994 |
| JP | 2004-029681 | A | 1/2004 |
| JP | 2006145622 | A * | 6/2006 |

OTHER PUBLICATIONS

Machine English translation of Japanese patent JP 06-027776 published on Feb. 4, 1994.*

* cited by examiner

*Primary Examiner* — Walter L Lindsay, Jr.
*Assistant Examiner* — Billy J Lactaoen
(74) *Attorney, Agent, or Firm* — Rabin & Berdo, P.C.

(57) ABSTRACT

A image forming apparatus includes a rotatable image bearing body, an exposing unit that irradiates the image bearing body to form a latent image, a developer bearing body that develops the latent image to form a developer image, a transfer unit that transfers the developer image to a recording medium, a feeding unit that feeds the recording medium, a density detecting unit that detects a developer density of the developer image transferred to the recording medium, and a speed difference control unit that controls a difference of a circumferential speed of the image bearing body and a feeding speed of the recording medium fed by the feeding unit. The speed difference is controlled based on a density of a thin line pattern transferred to the recording medium detected by the density detecting unit.

18 Claims, 12 Drawing Sheets

IMAGE FORMING APPARATUS HAVING SPEED DIFFERENCE CONTROL

BACKGROUND OF THE INVENTION

The present invention relates to an image forming apparatus such as a printer, a copier or the like using electrophotographic technique.

In an electrophotographic technique used in an image forming apparatus such as a printer, a copier or the like, an exposing device irradiates a photosensitive drum (as an image bearing body) with light so as to form a latent image according to inputted image data, and a developing device develops the latent image using a toner (as a developer) to form a toner image. The toner image is transferred to a sheet (as a recording medium), and then is fixed to the sheet.

Generally, the developing device includes a developing roller that supplies the toner to the photosensitive drum, a supplying roller that supplies the toner to the developing roller, a regulating blade that regulates a thickness of the toner layer on the developing roller. The toner is supplied by a detachable toner cartridge, and is charged by friction at a contact portion between the developing roller and the supplying roller and at a contact portion between the developing roller and the regulating blade according to a developing voltage and a supplying voltage respectively applied to the developing roller and the supplying roller.

In the image forming apparatus using such a developing device, it is desired to prevent a blurring of the toner image and a smear caused by adhesion of the toner due to time-dependent changes and environmental changes. For this purpose, the developing voltage and the supplying voltage are controlled based on a density of a density correction pattern formed on a transfer belt and a density of the image data to be printed (see, for example, Japanese Laid-Open Patent Publication No. 2004-29681).

Recently, there is a demand for an image forming apparatus capable of forming excellent images.

SUMMARY OF THE INVENTION

The present invention is intended to provide an image forming apparatus capable of forming excellent images.

The present invention provides an image forming apparatus including an image bearing body rotatably supported, an exposing unit that irradiates the image bearing body to form a latent image, a developer bearing body that develops the latent image using a developer to form a developer image, a transfer unit that transfers the developer image to a recording medium, a feeding unit that feeds a recording medium to a transferring position where the developer image is transferred to the recording medium, a density detecting unit that detects a developer density of the developer image transferred to the recording medium, and a speed difference control unit that controls a difference of a circumferential speed of the image bearing body and a feeding speed of the recording medium fed by the feeding unit. The speed difference control unit controls the difference of the circumferential speed of the image bearing body and the feeding speed of the recording medium based on a density of a thin line pattern transferred to the recording medium detected by the density detecting unit.

With such a configuration, it becomes possible to prevent image blurring of thin lines regardless of time-dependent changes and environmental changes, and to form excellent images.

The present invention also provides an image forming apparatus including an image bearing body rotatably supported, an exposing unit that irradiates the image bearing body to form a latent image, a developer bearing body that develops the latent image using a developer to form a developer image, a belt member that bears the developer image, a belt driving unit that drives the belt member, a density detecting unit that detects a developer density of the developer image on the belt member, and a speed difference control unit that controls a difference of a circumferential speed of the image bearing body and a driving speed of the belt member driven by the belt driving unit. The speed difference control unit controls the difference of the circumferential speed of the image bearing body and the driving speed of the belt member based on a density of a thin line pattern on the belt member detected by the density detecting unit.

Further scope of applicability of the present invention will become apparent from the detailed description given hereinafter. However, it should be understood that the detailed description and specific embodiments, while indicating preferred embodiments of the invention, are given by way of illustration only, since various changes and modifications within the spirit and scope of the invention will become apparent to those skilled in the art from this detailed description.

DETAILED DESCRIPTION OF THE PREFERRED EMBODIMENT

Hereinafter, embodiments of the present invention will be described with reference to drawings. The present invention is not limited to the embodiment described below, and modifications and improvements may be made to the invention without departing from the spirit and scope of the invention.

First Embodiment

First, a printer as an image forming apparatus according to the first embodiment of the present invention will be described. The printer is configured as a color electrophotographic printer including four image forming units corresponding to Black (K), Yellow (Y), Magenta (M) and Cyan (C) to thereby form a color image on a recording medium (for example, a sheet).

Figure 1:
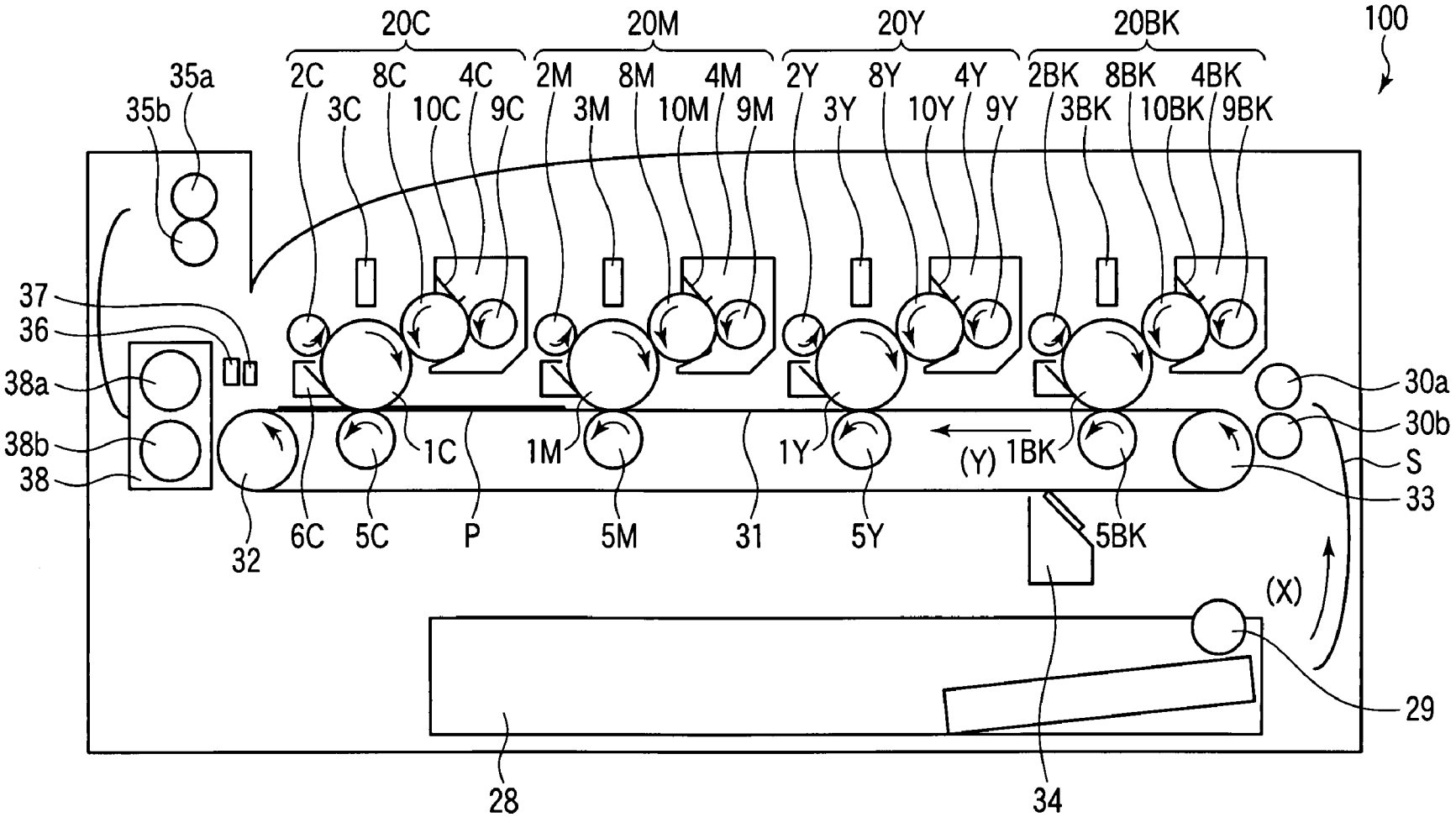
FIG. 1 is a schematic view showing a configuration of a printer according to the first embodiment of the present invention.

FIG. 1 is a schematic view showing the printer 100 according to the first embodiment. The printer 100 has a sheet feeding path S of substantially S-shape starting from a tray 28 in which the recording media P are stored and approaching an ejection roller 35*a* that ejects the recording medium P to the outside of the printer 100. Image forming units 20Bk, 20Y, 20M and 20C and a fixing unit 38 are disposed along the sheet feeding path S. Further, feeding rollers are also disposed along the sheet feeding path S for feeding the recording medium P through the image forming units 20Bk, 20Y, 20M and 20C.

The tray 28 is configured to store a stack of the recording medium P therein, and is detachably mounted to a lower part of the printer 100. A hopping roller 29 is disposed above the tray 28, and is configured to pick up the uppermost recording medium P of the stack in the tray and feed the recording medium P one by one in a direction shown by an arrow X.

A registration roller 30*a* and a pinch roller 30*b* are configured to sandwich the recording medium P (having been fed by the hopping roller 29) therebetween, and feed the recording medium P while correcting a skew of the recording medium P.

A transfer belt 31 is an endless belt member stretched around a driving roller 32 and an idle roller 33. The transfer belt 31 (i.e., a belt member) electrostatically absorbs the recording medium P and feeds the recording medium P in a direction shown by an arrow Y. The driving roller 32 (i.e., a belt driving unit) is driven by a belt motor 12 (described later) to move the transfer belt 31. The idle roller 33 rotates following the rotation of the driving roller 32 to stabilize the movement of the transfer belt 31. The transfer belt 31, the driving roller 32, the idle roller 33 and the belt motor 12 constitute a feeding unit.

A belt cleaning unit 34 is provided contacting the transfer belt 31. The belt cleaning unit 34 scrapes the toner remaining on the surface of the transfer belt 31 and collects the scraped toner so as to clean the transfer belt 31.

The ejection roller 35*a* and a pinch roller 35*b* are configured to eject the recording medium P (having passed the fixing unit 38) to the outside of the printer 100.

A CCD (Charge Coupled Device) sensor 36 and a light source 37 are disposed on the downstream side of the image forming units 20Bk, 20Y, 20M and 20C and on the upstream side of the fixing unit 38 along the sheet feeding path S.

The light source 37 emits light to the recording medium P or the transfer belt 31. The light source 37 is not limited, but it is preferable to use a cold cathode ray tube such as molybdenum or the like with a long lifetime and with a less power consumption.

The CCD sensor 36 as a density detecting unit includes a photodiode that generates a charge in proportion to an intensity of incident light, and a charge coupled device that transfers the charge to a control unit 14 (described later). The CCD sensor 36 generates a digital signal representing a contrast of light emitted by the light source 37 and reflected at the recording medium P (or the transfer belt 31) or the toner on the recording medium P (or the transfer belt 31).

The fixing unit 38 is disposed on the downstream side of the image forming units 20Bk, 20Y, 20M and 20C along the sheet feeding path S. The fixing unit 38 includes a heat roller 38*a* and a backup roller 38*b*. The heat roller 38*a* includes a cylindrical and hollow metal core (i.e., metal shaft) of aluminum or the like, a heat-resistant resilient layer of silicone rubber or the like covering the metal core, and a PFA (Tetra fluoro ethylene-perfluoro alkylvinyl ether copolymer) tube covering the resilient layer. A not shown heater such as a halogen lamp or the like is provided inside the metal core of the heat roller 38*a*. The backup roller 38*b* includes a metal core (i.e., metal shaft) of aluminum or the like, a heat-resistant resilient layer of silicone rubber or the like covering the metal core, and a PFA tube covering the resilient layer. The backup roller 38*b* is pressed against the heat roller 38*a* so as to form a nip portion therebetween. As the recording medium P with the transferred toner image is nipped between the heat roller 38*a* and the backup roller 38*b*, the toner on the recording medium P is molten so that the toner image is fixed to the recording medium P.

Next, the image forming units 20K, 20Y, 20M and 20C will be described. In this regard, the image forming units 20K, 20Y, 20M and 20C have the same configurations except the toner stored in toner cartridges (not shown) mounted to respective developing units 4. Therefore, the image forming unit 20C will be herein described as a representing example of the image forming units 20K, 20Y, 20M and 20C.

The image forming unit 20C includes a photosensitive drum 1C as an image bearing body, a charging roller 2C as a charging device, an LED (Light Emitting Diode) head 3C as an exposing unit, a developing unit 4C, a transferring roller 5C as a transferring unit, and a cleaning unit 6C.

The photosensitive drum 1C is composed of a conductive supporting body and a photoconductive layer formed thereon. For example, the photosensitive drum 1C is composed of an organic photosensitive body including a metal shaft of aluminum or the like (as the conductive supporting body) on which a charge generation layer and a charge transporting layer (as the photoconductive layer) are layered.

The charging roller 2C is configured to uniformly charge the surface of the photosensitive drum 1C, and is composed of a metal shaft of stainless steel or the like covered with a conductive resilient layer of epichlorohydrin rubber or the like.

The LED head 3C is configured to selectively irradiate the uniformly charged surface of the photosensitive drum 1C so as to form a latent image based on inputted image data. The LED head 3C includes LED elements, LED driving elements and a lens array. The LED head 3C is disposed so that lights emitted by the LED elements are focused on the surface of the photosensitive drum 1C.

The developing unit 4C is configured to cause the toner to adhere to the latent image (formed on the photosensitive drum 1C by the LED head 3C) so as to develop the latent image and to form the toner image. The developing unit 4C includes a developing roller 8C (as a developer bearing body), a supplying roller 9C (as a supplying member) disposed contacting the surface of the developing roller 8C and a regulating blade 10C (as a regulating member) disposed contacting the surface of the developing roller 8C. The developing roller 8C is composed of a metal shaft (i.e., a metal core) covered with a conductive resilient body such as urethane rubber or the like in which carbon black is dispersed. Further, the surface of the resilient layer is treated with isocyanate. The supplying roller 9C is composed of a metal shaft (i.e., a metal core) of stainless steel or the like covered with a conductive foam resilient body. The regulating blade 10C is composed of a plate member of stainless steel or the like. The developing roller 8C is disposed contacting the surface of the photosensitive drum 1C. A toner cartridge (not shown) for storing the toner is detachably mounted on an upper part of the developing unit 4C. The toner is supplied by the toner cartridge, and is supplied to the developing roller 80 via the supplying roller 9C. The thickness of the toner layer on the surface of the developing roller 8C is regulated by the regulating blade 10C.

The transfer roller 5C is configured to transfer the toner image formed on the surface of the photosensitive drum 1C (by the developing unit 4C) to the recording medium P or the transfer belt 31. The transfer roller 5C is composed of, for example, a conductive foam resilient body.

The cleaning device 6C is configured to scrape a residual toner that remains on the surface of the photosensitive drum 1C or a waste toner having been moved from the developing unit 4C to the photosensitive drum 1C, and to store the scraped toner. The cleaning device 6C has, for example, a rubber blade. The rubber blade is disposed so that a tip end thereof abuts against the surface of the photosensitive drum 1C. As the photosensitive drum 1C rotates, the residual toner or the waste toner is scraped from the surface of the photosensitive drum 1C by the rubber blade.

The photosensitive drum 1Bk, 1Y, 1M and 1C are driven an ID (Image Drum) motor 11 (FIG. 2) to rotate in directions shown by arrows in FIG. 1. The drive roller 32 is driven a belt motor 12 (FIG. 2) to rotate in a direction shown by an arrow in FIG. 1. The developing rollers 8Bk, 8Y, 8M and 8C and the supplying rollers 9Bk, 9Y, 9M and 9C are driven by rotations transmitted via gears from the photosensitive drums 1Bk, 1Y, 1M and 1C. The charging rollers 2Bk, 2Y, 2M and 2C are rotated by friction caused by contact with the surfaces of the photosensitive drums 1Bk, 1Y, 1M and 1C.

Figure 2:
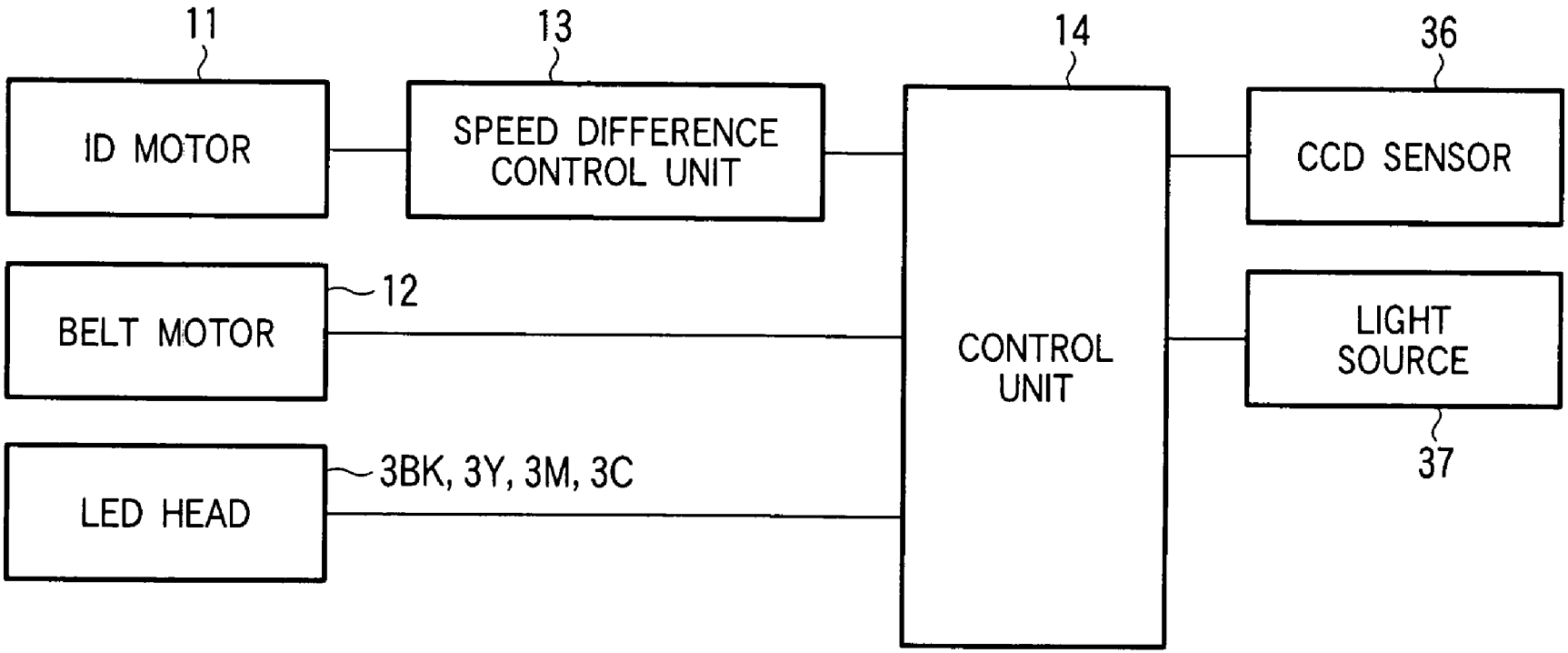
FIG. 2 is a block diagram showing a control system of the printer according to the first embodiment of the present invention.

Next, a control system of the printer 100 will be described with reference to FIG. 2. As shown in FIG. 2, the ID motor 11 for driving the rotations of the photosensitive drums 1Bk, 1Y, 1N and 1C is connected with a speed difference control unit 13. Based on information of a rotation speed of the belt motor 12 outputted from the control unit 14 (i.e., a feeding speed of the recording medium P fed by the transfer belt 31), the speed difference control unit 13 controls a difference between the circumferential speed of the photosensitive drums 1Bk, 1Y, 1M and 1C and the feeding speed of the recording medium P fed by the transfer belt 31. The control unit 14 is connected with the above described speed difference control unit 13, the belt motor 12, the LED heads 3Bk, 3Y, 3M and 3C, the CCD sensor 36 and the light source 37. The control unit 14 controls the operations of the speed difference control unit 13, the belt motor 12, the LED heads 3Bk, 3Y, 3M and 3C, the CCD sensor 36, and the light source 37, and performs a processing of detected images or the like.

Although not shown in FIGS. 1 and 2, the printer 100 further includes a microprocessor, an I/O port and memory devices such as ROM (Read Only Memory) and RAM (Random Access Memory). The memory devices include a receiving memory that temporality stores image data inputted via the I/O port, and an image data editing memory that receives the image data from receiving memory and stores image data formed by editing the image data. The printer 100 further includes a display portion with a display unit such as an LCD (Liquid Crystal Display) for displaying a condition of the printer 100, and an operating portion with an input unit such as a touch panel or the like operated by a user. The printer 100 further includes various kinds of sensors such as a sheet position detection sensor and a temperature/humidity sensor, a temperature control unit for controlling the temperature of the fixing unit 38, high voltage power sources for applying voltages to the respective rollers, and the like.

Next, an image forming process of the above configured printer 100 will be described.

First, the control unit 14 controls the high voltage power sources (not shown) to apply a charging voltage to the charging rollers 2Bk, 2Y, 2M and 2C so as to uniformly charge the surfaces of the photosensitive drums 1Bk, 1Y, 1M and 1C. Then, the control unit 14 controls the LED heads 3Bk, 3Y, 3M and 3C to emit lights according to the image data (formed by editing the image data received via the I/O port), so as to form latent images on the surfaces of the photosensitive drums 1Bk, 1Y, 1M and 1C.

The control unit 14 controls the high voltage power sources (not shown) to apply a developing voltage to the developing rollers 8Bk, 8Y, 8M and 8C with toner layers formed thereon so as to develop the latent images on the surfaces of the photosensitive drums 1Bk, 1Y, 1M and 1C. The supplying rollers 9Bk, 9Y, 9M and 9C are applied with a supplying voltage, and the regulating blades 10Bk, 10Y, 10M and 10C are applied with a regulating blade voltage, by high voltage power sources (not shown) so that the toner layers of the developing rollers 8Bk, 8Y, 8M and 8C have uniform thicknesses and charge amounts of the toners thereof are in a predetermined range.

Here, when the printer 100 is operated under a normal temperature and normal humidity environment using a negatively chargeable toner composed of, for example, a polystyrene resin added with silica or the like (as external additives) for providing fluidity, the respective voltages are, for example, as follows: the charging voltage is set to −1000V, the developing voltage is set to −200V, the supplying voltage is set to −280V, and the regulating blade voltage is set to −280V.

The surfaces of the photosensitive drums 1Bk, 1Y, 1M and 1C are charged by the charging rollers 2Bk, 2Y, 2M and 2C applied with a predetermined voltage or higher voltage. A surface potential of the photosensitive drums 1Bk, 1Y, 1M and 1C vary according to the applied charging voltage.

When the charging voltage (applied to the charging rollers 2Bk, 2Y, 2M and 2C) is −1000V as described above, the surface potential of the photosensitive drums 1Bk, 1Y, 1M and 1C is −500V. An electrostatic voltage of the latent images (formed by the LED heads 3Bk, 3Y, 3M and 3C) is −50V. The latent images are reversely developed by the toners of the developing rollers 8Bk, 8Y, 8M and 8C, so that the toner images are formed on the surfaces of the photosensitive drums 1Bk, 1Y, 1M and 1C.

Then, the control unit 14 controls the driving roller 32 to rotate to move the transfer belt 31, and controls the high voltage power sources (not shown) to apply the transfer voltage to the transfer rollers 5Bk, 5Y, 5M and 5C, so as to transfer the toner images from the photosensitive drums 1Bk, 1Y, 1M and 1C to the recording medium P while feeding the recording medium P.

The recording medium P with the toner image having been transferred thereto is fed to the fixing unit 38. In the fixing unit 38, the toner image is applied with heat and pressure, and is fixed to the recording medium P. The recording medium P with the toner image having been fixed thereto is ejected by the ejection roller 35*a* and the pinch roller 35*b* to the outside of the printer 100. With this, the image forming process ends.

Next, a blurring of thin lines and a density level described in this embodiment will be described with reference to FIGS. 3A and 3B.

Figure 3A:
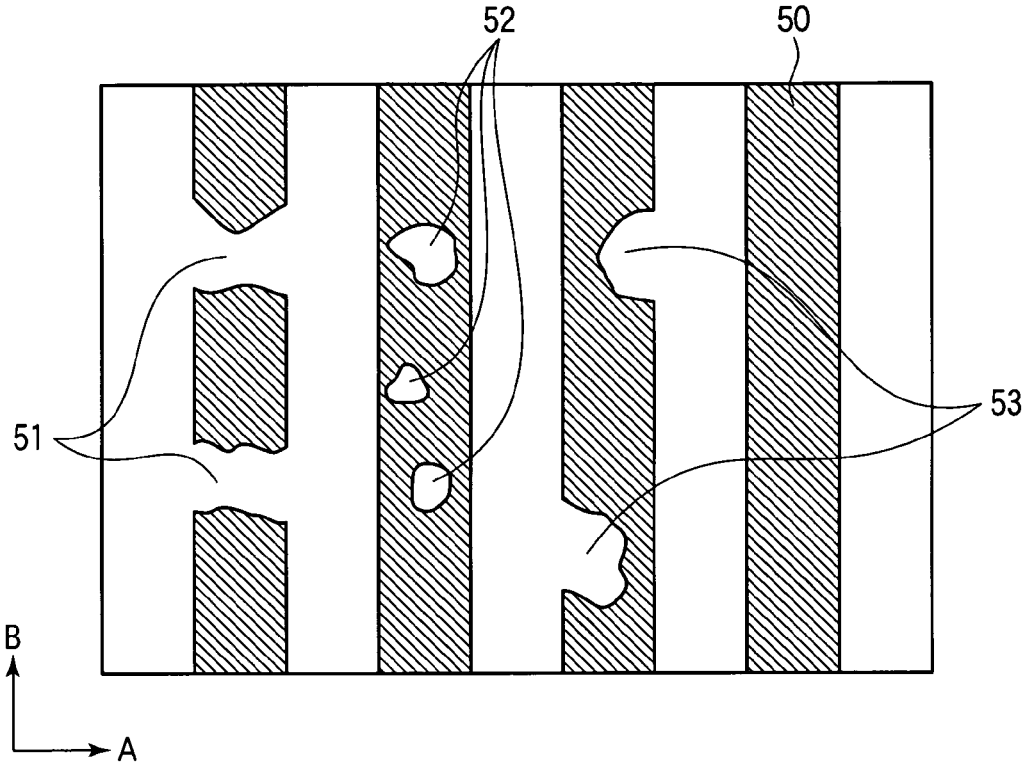
FIG. 3A is a schematic view for illustrating an example of blurring of thin lines.
Figure 3B:
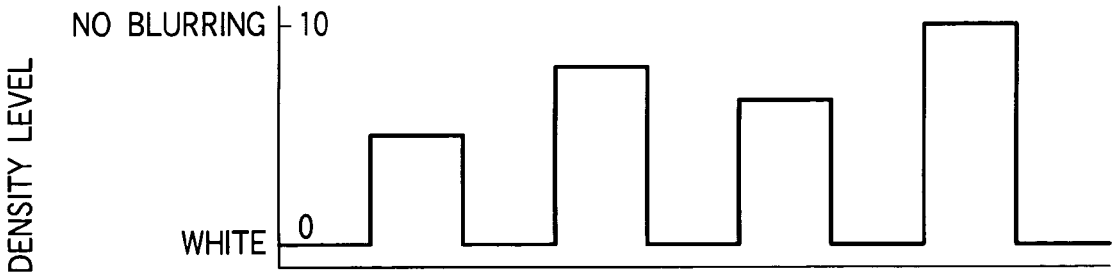
FIG. 3B is a schematic view for illustrating a density level of the thin lines shown in FIG. 3A.

As shown in FIG. 3A, in this embodiment, a line 50 which is printed with a width of 1 point (i.e., 1/72 inch) or narrower is referred to as a "thin line". Further, a "blurring of thin lines" indicates that the toners (that normally constitute parts of the thin lines 50) are separated from the thin lines 50 so as to form disconnections 51, hole areas 52 and chips 53 of the thin lines 50. In this embodiment, the blurring of the thin lines is evaluated based on a density level (FIG. 3B).

The density level is obtained as follows. Toner density (i.e., developer density) of the thin lines 50 is measured in a main scanning direction A using the CCD sensor 36. The measured toner density is accumulated in a sub-scanning direction B. Then, a difference (hereinafter, referred to as an "average density difference") between an averaged toner density of a printed area (i.e., thin lines) and an averaged density of a non-printed area (i.e., white portion) is calculated, which gives the density level. The density level of the non-image area (i.e., white portion) is level 0, and the density level of the thin line with no blurring is level 10. The density level of the thin line in the worst case is level 1. The density levels between the level 1 and the level 10 are classified into level 2 through level 9. The level 8 is determined as an allowable lower limit.

In this regard, the main scanning direction A is a direction parallel to an axial direction of each of the photosensitive drums 1Bk, 1Y, 1M and 10. The sub-scanning direction B is a direction perpendicular to the main scanning direction A.

Here, a relationship between the above described density level and a circumferential speed ratio will be described with reference to FIG. 4. The "circumferential speed ratio" is a ratio of the circumferential speed of the photosensitive drums 1Bk, 1Y, 1M and 1C to the feeding speed of the recording medium P.

Figure 4:
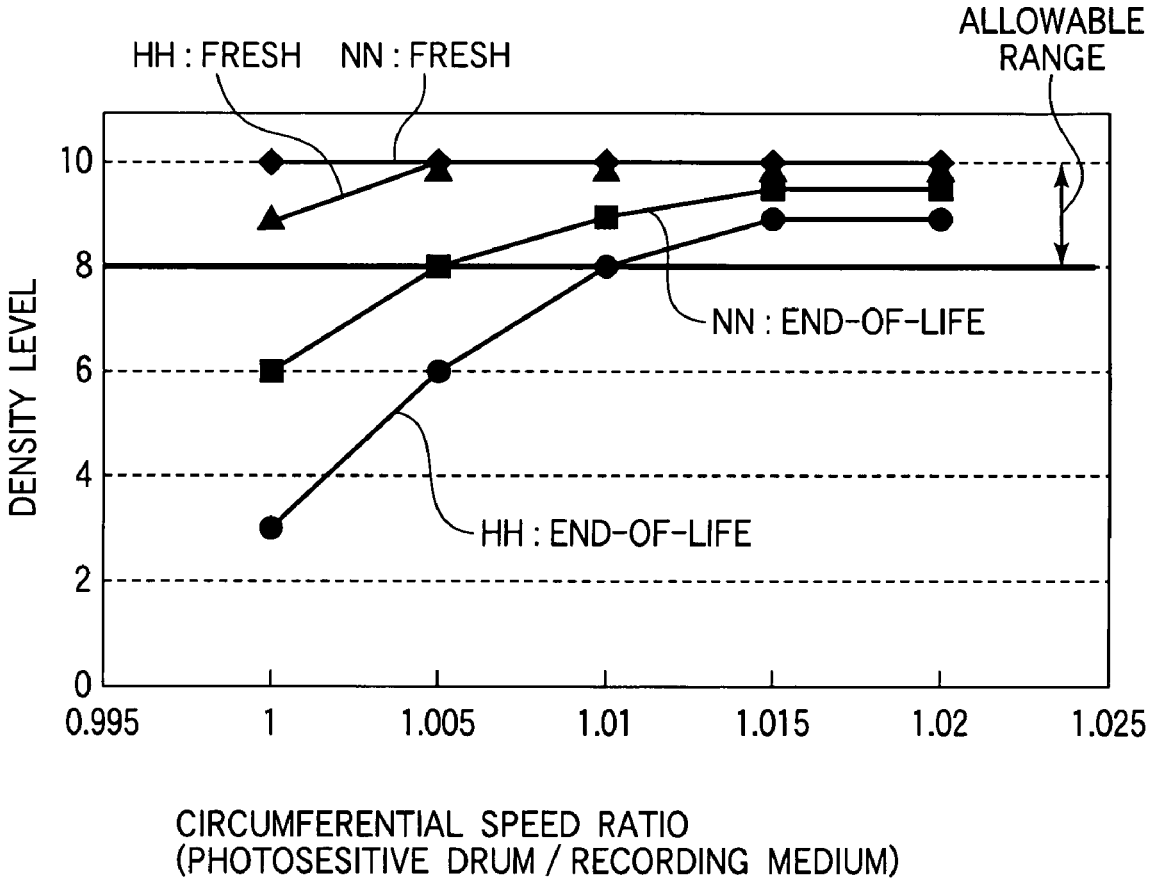
FIG. 4 is a graph showing a relationship between the density level and a circumferential speed ratio.

In FIG. 4, a horizontal axis indicates the circumferential speed ratio, and a vertical axis indicates the density level. A printing of the thin lines was performed when the image forming units 20Bk, 20Y, 20M and 20C were fresh (new), and when the lifetimes of the image forming units 20Bk, 20Y, 20M and 20C expired. The printing was performed under a normal temperature and normal humidity environment (i.e., NN environment: 22° C., 55% rh), and under a high temperature and high humidity environment (i.e., HH environment: 28° C., 80% rh). The density levels of the printed images were measured.

From FIG. 4, it can be understood that the density level is enhanced (i.e., the blurring of the thin lines falls within an allowable range), as the circumferential speed of the photosensitive drums 1Bk, 1Y, 1M and 1C becomes higher relative to the feeding speed of the recording medium P. The reason is considered to be that, as the circumferential speed of the photosensitive drums 1Bk, 1Y, 1M and 1C becomes higher relative to the feeding speed of the recording medium P, the force with which the toner is pressed against the recording medium P increases, so that the transfer efficiency also increases.

Therefore, by controlling the circumferential speed difference based on the density level of a thin line pattern formed on the recording medium P or the transfer belt 31, the blurring of the thin lines can be suppressed and excellent image can be consistently obtained.

Figure 5A:
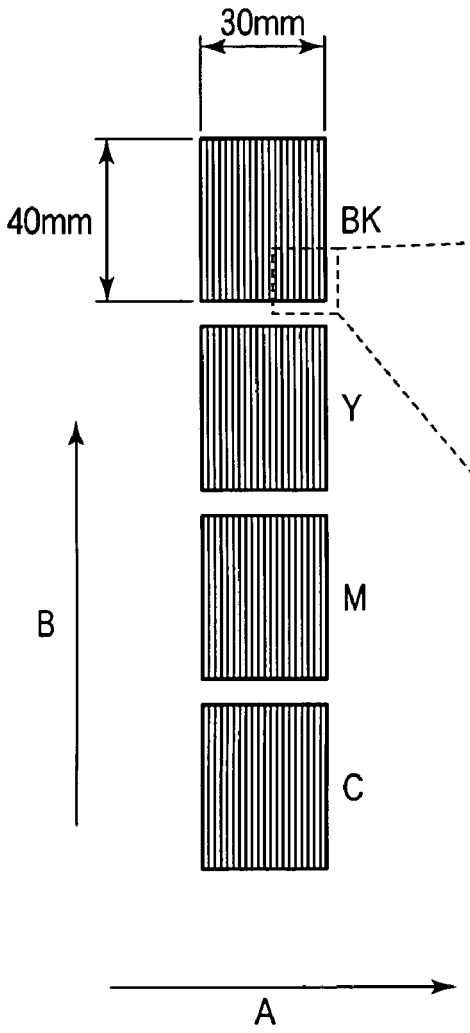
FIGS. 5A and 5B are schematic views for illustrating a thin line pattern used in an ID speed correction process according to the first embodiment of the present invention.
Figure 5B:
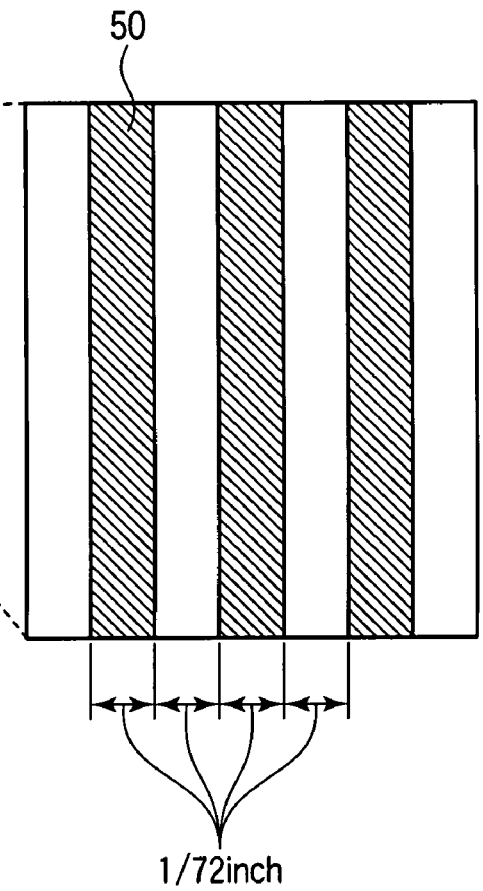

In this embodiment, the density level is calculated based on the toner density of a thin line pattern formed on the recording medium P as shown in FIGS. 5A and 5B. To be more specific, a vertical-striped pattern (i.e., the thin line pattern) including thin lines 50 elongated in the sub-scanning direction B and each having the width of 1 point (1/72 inch) was transferred to the area (i.e., detection area) of 40 mm long and 30 mm wide on the recording medium P using the toners of Black (Bk), Yellow (Y), Magenta (M) and Cyan (C) in this order. Then, the toner density of the thin line pattern (the vertical-striped pattern) was measured using the CCD sensor 36, so as to obtain the density level.

In this regard, the thin line pattern used in this embodiment does not limit the scope of the present invention. For example, the size of the detected area, the width of the thin lines and the order of the transferring of the images of the respective colors can be modified according to the resolution of the CCD sensor 36 and a kind of the detecting unit (i.e., the CCD sensor 36, a density sensor or other detecting unit). Further, although the thin line pattern on the recording medium P is detected in this embodiment, but it is also possible to detect the toner density of the thin line pattern transferred to the transfer belt 31.

In this embodiment, the CCD sensor 36 used to measure the toner density of the thin line pattern has a sufficiently high resolution compared with the thin line pattern. For this reason, the CCD sensor 36 having a resolution of 1200 dpi is used in this embodiment. The CCD sensor 36 is disposed at a center portion in the main scanning direction A. However, the size and position of the CCD sensor 36 is not limited to this example. For example, the CCD sensor 36 can be disposed to cover a whole area in the main scanning direction A, or can be disposed at both ends in the main scanning direction A.

Next, a correction process of the circumferential speed of the photosensitive drums 1Bk, 1Y, 1M and 1C according to the first embodiment will be described with reference to FIG. 6. Hereinafter, the circumferential speed of the photosensitive drums 1Bk, 1Y, 1M and 1C is referred to as "ID speed". The correction process of the ID speed is referred to as "ID speed correction process".

When the ID speed correction process starts (step S01), the control unit 14 set a correction coefficient N to zero (step S02), and sends instruction to the speed difference control unit 13 so as to change the ID speed to (100+0.05N) %. In other words, the ID speed is set to be faster than the feeding speed of the recording medium P by 0.05N %.

On receiving the instruction, the speed difference control unit 13 changes the ID speed to (100+0.05N) % (step S03).

Then, the control unit 14 operates the image forming apparatus 100 to form the thin line pattern on the recording medium P using the above described image forming process (step S04).

Then, the control unit 14 controls the CCD sensor 36 and the light source 37 to detect the toner density of the thin line pattern on the recording medium P, and calculates the average density difference as described above. Further, the control unit 14 determines the density level based on the average density difference (step S05). To be more specific, the density levels having been classified based on visual inspection are preliminarily associated with the above described average density differences, and are stored, for example, as a table in a memory device (not shown). The control unit 14 refers to the table stored in the memory device (not shown), and determines the density level based on the average density difference (having been calculated based on the toner density detected by the CCD sensor 36).

Then, the control unit 14 determines whether the density level is higher than or equal to 8 (step S06). If the density level is higher than or equal to 8 (YES in step S06), the control unit 14 sends instruction to the speed difference control unit 13 so as to set the ID speed to the ID speed which was set in the step S03.

Upon receiving the instruction, the speed difference control unit 13 sets the ID speed to the ID speed which was set which was set in the step S03 (step S07). Then, the control unit 14 ends the ID speed correction process.

If the density level is less than 8 (NO in step S06), the control unit 14 determines whether the correction coefficient N is 4 (step S08). If the correction coefficient is 4 (YES in step S08), the control unit 14 proceeds to the above described step S07. If the correction coefficient N is not 4 (NO in step S08), the control unit 14 increments the correction coefficient N by 1 (step S09), and repeats the steps S03 through S06.

In this embodiment, the upper limit of the difference of the ID speed of the photosensitive drums 1Bk, 1Y, 1M and 10 is set to 0.2% because there is a possibility that color shift may occur when the difference is too large, and set as close to as 0% in a range in which the blurring of thin lines is allowable.

As described above, according to the first embodiment of the present invention, the circumferential speed of the photosensitive drums 1Bk, 1Y, 1M and 1C (with respect to the feeding speed of the recording medium P) is set in accordance with the density level of the thin line pattern. In other words, the speed difference correction is performed while taking into account the thin lines. Therefore, it becomes possible to prevent the blurring of the thin lines and to consistently form excellent images regardless of time-dependent changes and environmental changes.

Second Embodiment

A printer according to the second embodiment of the present invention is configured to perform the ID speed correction (as described in the first embodiment) after a density correction using a density correction pattern formed on the recording medium P or the transfer belt 31, in order to ensure prevention of the blurring of the thin lines and to consistently form excellent image.

The printer 200 of the second embodiment has the same components as those of the printer 100 of the first embodiment. Further, the image forming process of the printer 200 is the same as that of the printer 100. Therefore, components of the printer 200 that are the same as those of the printer 100 are assigned the same reference numerals, and duplicate descriptions will be omitted. The following description will be focused on differences between the first and second embodiments.

Figure 7:
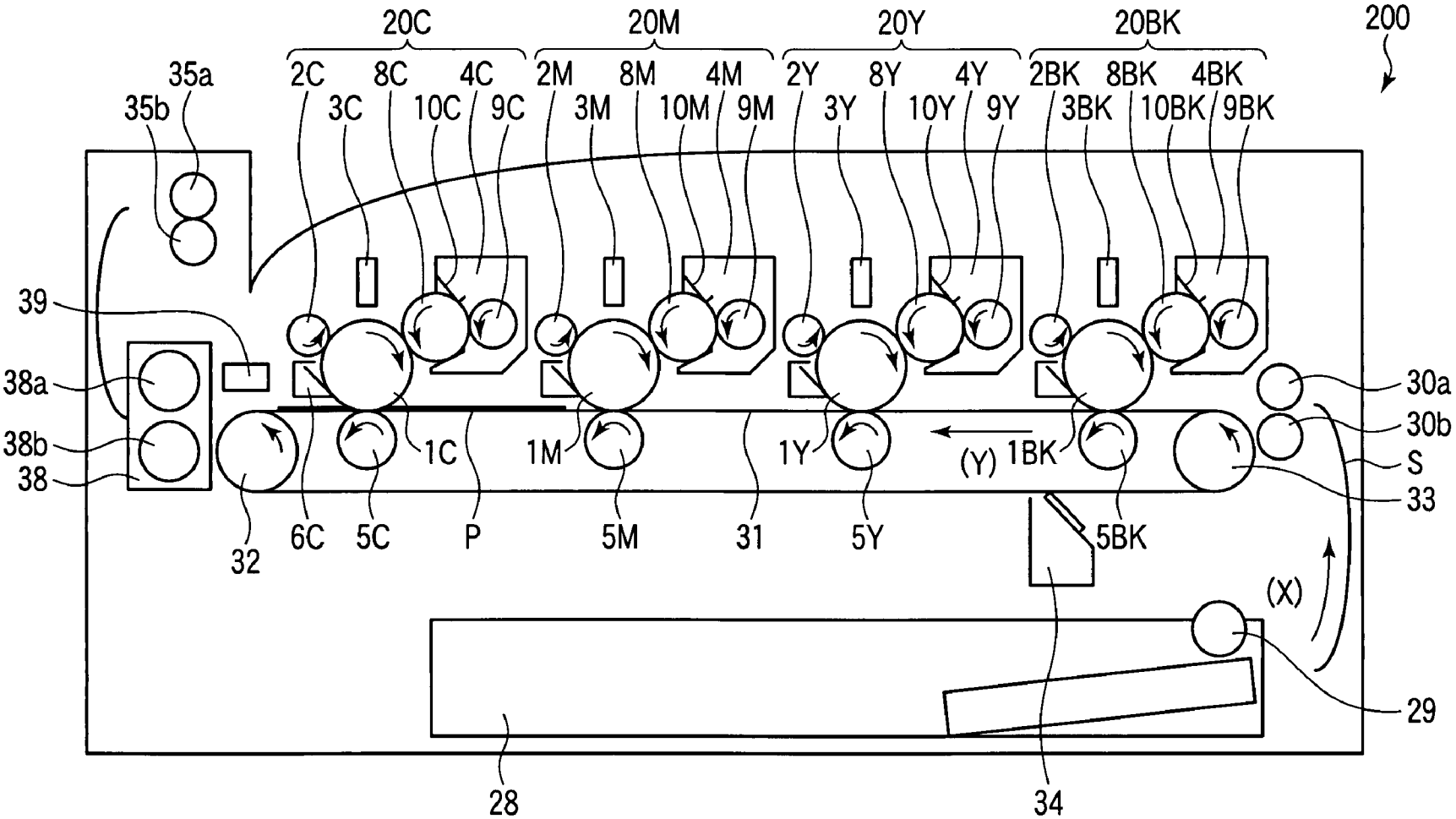
FIG. 7 is a schematic view showing a configuration of a printer according to the second embodiment of the present invention.

FIG. 7 is a schematic view showing a configuration of the printer 200. The printer 200 has a density sensor 39 instead of the CCD sensor 36 and the light source 37 (FIG. 1) of the printer 100.

Figure 8:
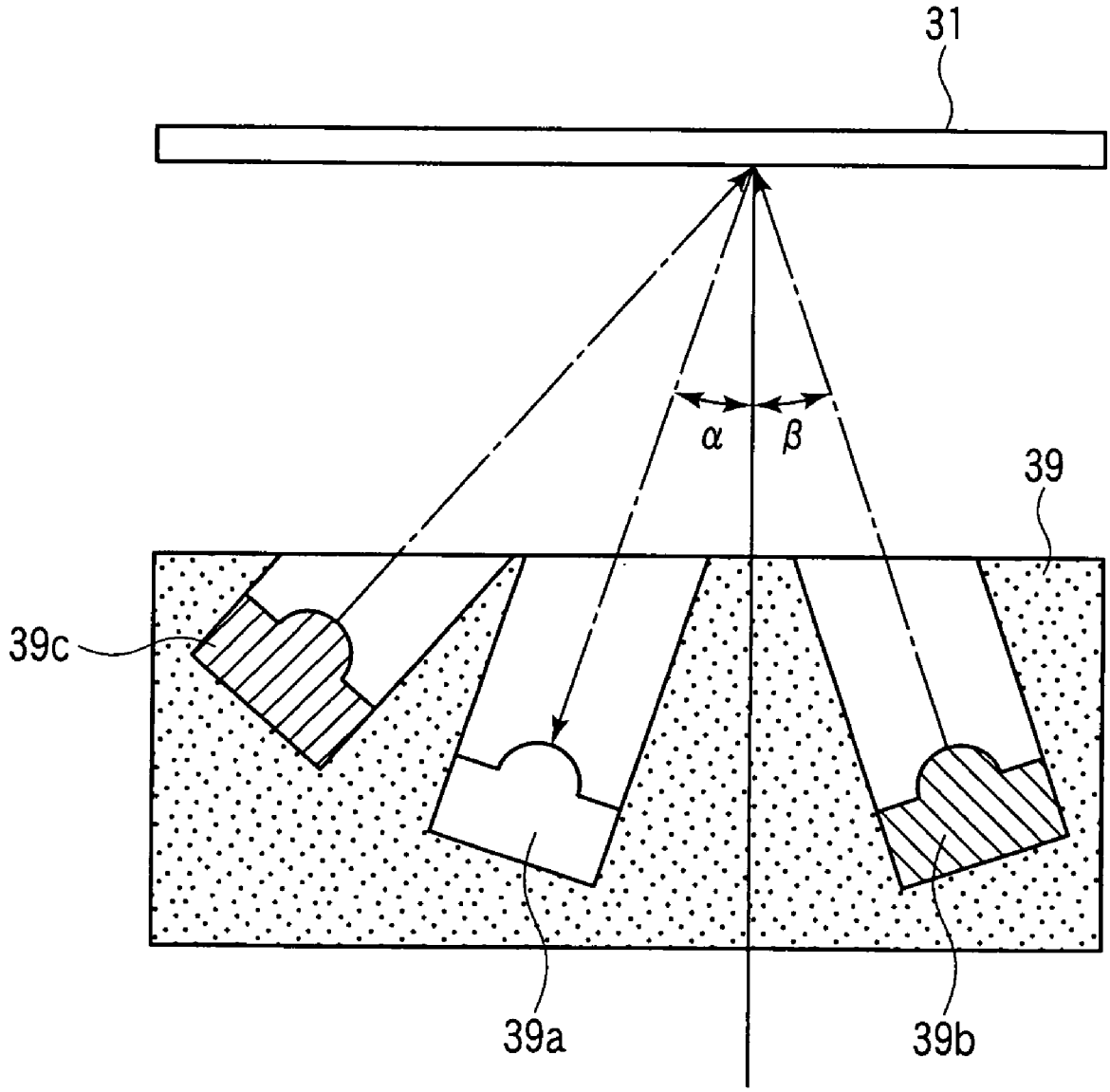
FIG. 8 is a schematic view showing a density sensor according to the second embodiment of the present invention.

FIG. 8 is a schematic view showing the density sensor 39. The density sensor 39 is disposed facing the transfer belt 31. The density sensor 39 emits infrared light and red light to the toner on the recording medium P or the transfer belt 31, and detects the reflected light so as to detect the toner density. To be more specific, the density sensor 39 has a light emitting element 39*b* (LED) that emits the light and a light receiving element 39*a* that receives normally reflected light from the recording medium P or the transfer belt 31. The density sensor 39 includes another light emitting element 39*c* (LED) that emits the light, and the light receiving element 39*a* receives diffusely-reflected light from the recording medium P or the transfer belt 31.

Figure 9:
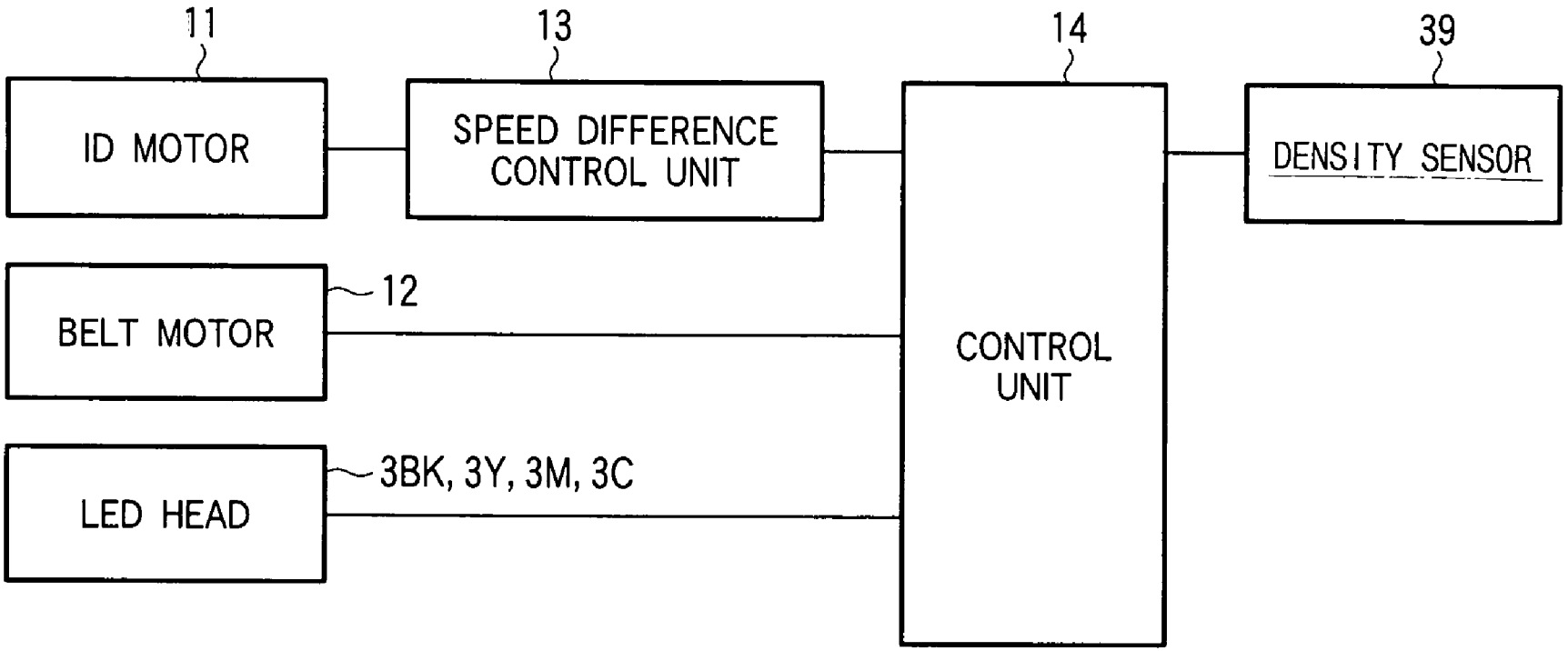
FIG. 9 is a block diagram showing a control system of the printer according to the second embodiment of the present invention.

FIG. 9 is a block diagram showing a control system of the printer 200. As shown in FIG. 9, the ID motor 11 for controlling the rotations of the photosensitive drums 1Bk, 1Y, 1M and 1C is connected with the speed difference control unit 13. Based on information of the rotation speed of the belt motor 12 outputted from the control unit 14, i.e., the feeding speed of the recording medium P fed by the transfer belt 31, the speed difference control unit 13 controls a difference between the circumferential speed of the photosensitive drums 1Bk, 1Y, 1M and 1C and the feeding speed of the recording medium P fed by the transfer belt 31. The control unit 14 controls the operations of the speed difference control unit 13, the belt motor 12, the LED heads 3Bk, 3Y, 3M and 3C and the density sensor 39, and performs a processing of detected images or the like.

Next, the blurring of thin lines and the density level in the second embodiment will be described with reference to FIGS. 3A and 3B. As was described in the first embodiment, a "thin line" indicates a line 50 (FIG. 3A) which is printed with a width of 1 point (i.e., 1/72 inch) or narrower. Further, a "blurring of thin lines" indicates that the toners (that normally constitute parts of the thin lines 50) are separated from the thin lines 50 so as to form disconnections 51, hole areas 52 and chips 53 of the thin lines 50 (FIG. 3A). The blurring of the thin lines is evaluated based on the density level. In the second embodiment, the density level is determined by a difference (referred to a density difference) between a density of 50% duty pattern (calculated based on a result of a density correction process as described later) and an averaged density of a whole printed area of thin lines. The density level of the non-image area (i.e., white portion) is level 0, and the density level of the thin line with no blurring is level 10. The density level of the thin line in the worst case is level 1. The density levels between the level 1 and the level 10 are classified into level 2 through level 9. The level 8 is determined as an allowable lower limit. The density levels having been classified based on visual inspection are preliminarily associated with the above described density differences, and are stored, for example, as a table in a memory device (not shown). The control unit 14 refers to the table stored in the memory device (not shown), and determines the density level based on the density difference (having been calculated based on the toner density obtained by the density sensor 39).

Figure 10:
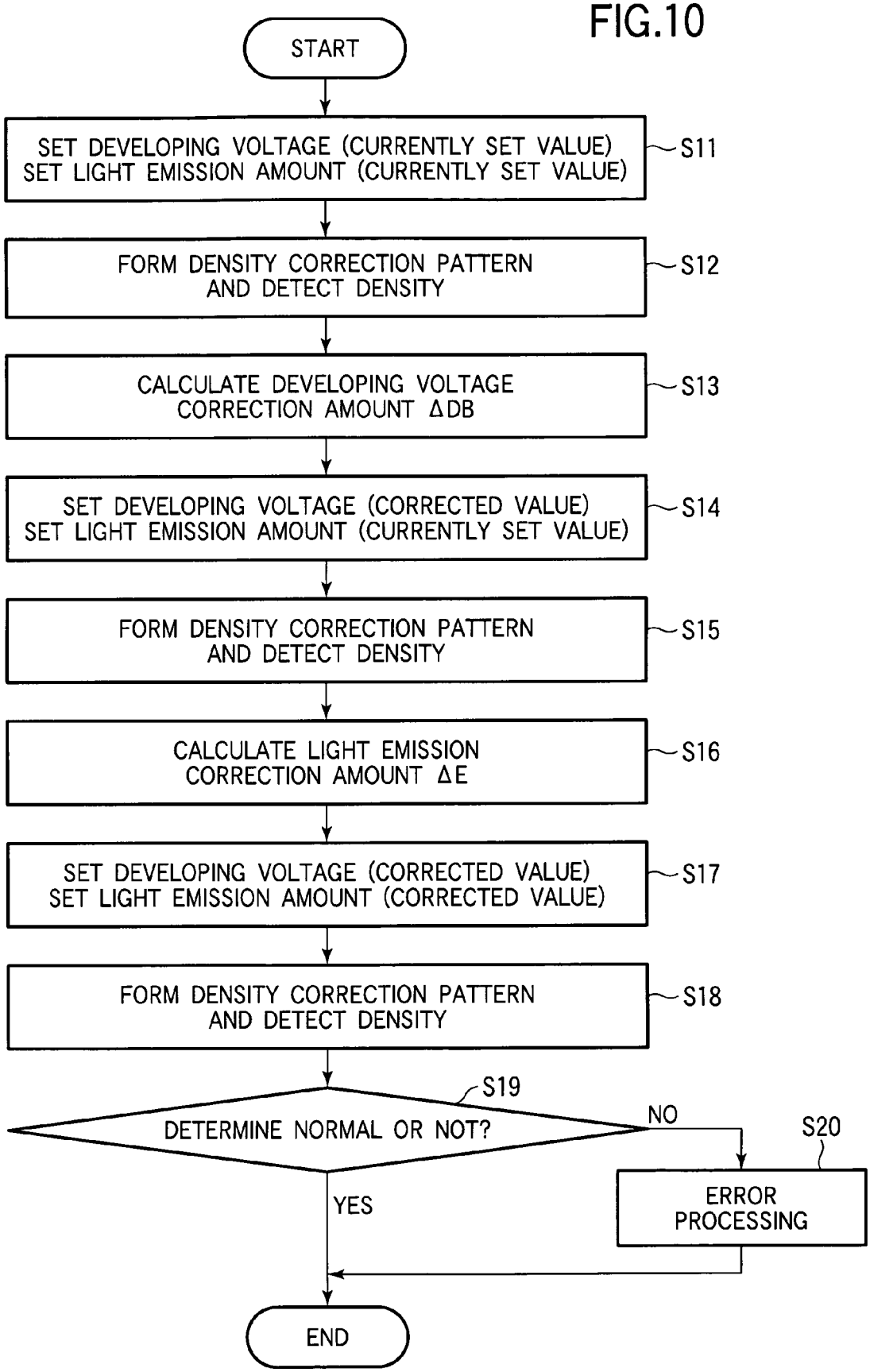
FIG. 10 is a flow chart showing a density correction process according to the second embodiment of the present invention.
Figure 11:
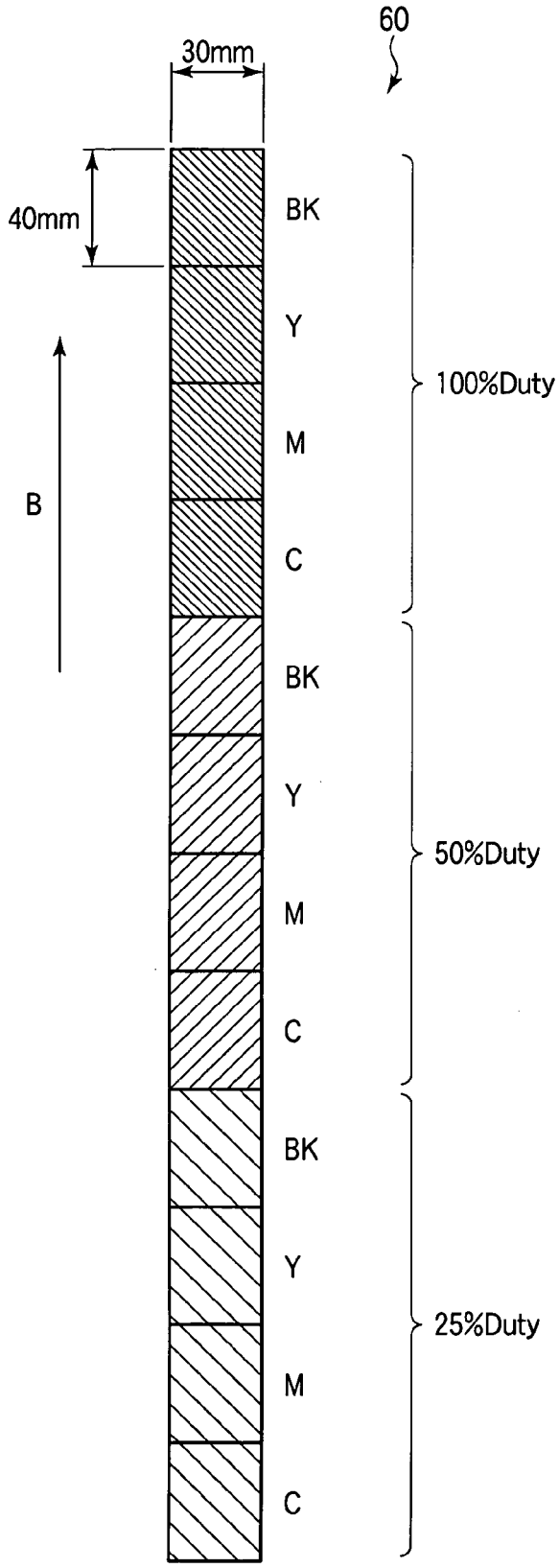
FIG. 11 is a schematic view for illustrating an example of a density correction pattern used in the density correction process according to the second embodiment of the present invention.

Next, the density correction process (performed before the ID speed correction process) will be described with reference to FIGS. 10 and 11. FIG. 10 is a flow chart showing the density correction process. FIG. 11 is a schematic view showing the density correction pattern formed on the recording medium P or the transfer belt 31 during the density correction process.

As shown in FIG. 11, the density correction pattern is elongated in the sub-scanning direction B, and includes 100% duty pattern, 50% duty pattern and 25% duty pattern each of which includes Black (Bk), Yellow (Y), Magenta (M) and Cyan (C) portions of a size of 40 mm long and 30 mm wide.

As shown in FIG. 10, when the density correction process starts, the control unit 14 sets the developing voltage (applied to the developing rollers 8Bk, 8Y, 8M and 8C) to a currently set voltage which has been set for image forming, and sets the light emission amount of the LED heads 3Bk, 3Y, 3M and 3C to a currently set light emission amount (step S11).

Next, the control unit 14 operates the printer 200 to perform the image forming process while applying the developing voltage (having been set in the step S11) to the developing rollers 8Bk, 8Y, 8M and 8C, and drives the LED heads 3Bk, 3Y, 3M and 3C to emit lights at the light emission amount (having been set in the step S11) so as to form the density correction pattern of FIG. 11, and detects the density of the density correction pattern using the density sensor 39 (step S12).

When the density detection is completed, the control unit 14 calculates a correction amount ΔDB of the developing voltage based on the result of the density detection and the like in order to adjust the image density to a predetermined density (step S13). The developing voltage correction amount ΔDB can be determined based on detected image densities Ds100, Ds50 and Ds25 of the 100% duty pattern, the 50% duty pattern and the 25% duty pattern of the density correction pattern (FIG. 11) detected by the density sensor 39 and target image densities Dt100, Dt50 and Dt25 of respective reference patch images. The developing voltage correction amount ΔDB is determined using the following equation:

$$\Delta DB = DA \times \{a \times (Ds100 - Dt100) + b \times (Ds50 - Dt50) + c \times (Ds25 - Dt25)\}/(a+b+c)$$

In the above described equation, a, b and c are weighting coefficients for calculating an average image density error based on the respective image density errors. The weighting coefficients a, b and c are set to standard values representing changing amounts of the image densities with respect to the change of the developing voltage (which are preliminarily measured). DA is a unit adjustment factor for adjusting the above described average image density error to the target image density.

After the control unit 14 calculates the developing voltage correction amount ΔDB, the control unit 14 corrects the developing voltage by ΔDB, and sets the corrected developing voltage applied to the developing rollers 8Bk, 8Y, 8M and 8C (step S14). In this step, the control unit 14 does not correct the light emission amount of the LED heads 3Bk, 3Y, 3M and 3C. In other words, the light emission amount of the LED heads 3Bk, 3Y, 3M and 3C is the same as previously set.

After the control unit 14 sets the corrected developing voltage, the control unit 14 operates the printer 200 to perform the image forming process so as to form the density correction pattern of FIG. 11, and detects the density of the density correction pattern using the density sensor 39 (step S15).

When the density detection is completed, the control unit 14 calculates a correction amount ΔE of the light emission amount of the LED heads 3Bk, 3Y, 3M and 3C based on the result of the density detection and the like in order to adjust the image density to a predetermined density (step S16). The light emission correction amount ΔE can be determined based on detected image densities Ds100', Ds50' and Ds25' of the 100% duty pattern, the 50% duty pattern and the 25% duty pattern of the density correction pattern (FIG. 11) detected by the density sensor 39 and the target image densities Dt100, Dt50 and Dt25 of the respective reference patch images. The light emission correction amount ΔE is determined using the following equation:

$$\Delta E = DE \times \{a' \times (Ds100' - Dt100) + b' \times (Ds50' - Dt50) + c' \times (Ds25' - Dt25)\}/(a'+b'+c')$$

In the above described equation, a', b' and c' are weighting coefficients for calculating an average image density error based on the image density errors. DE is a unit adjustment factor of the light emission amount of the LED head 38*k*, 3Y, 3M and 3C for adjusting the above average image density error to the target image density.

Then, the control unit 14 calculates the light emission amount based on the currently set light emission amount and the above described light emission correction amount ΔE, and sets the corrected light emission amount of the LED head 3Bk, 3Y, 3M and 3C (step S17).

After the control unit 14 sets the corrected light emission amount, the control unit 14 performs the image forming process while applying the corrected developing voltage to the developing rollers 8Bk, 8Y, 8M and 8C, and drives the LED heads 3Bk, 3Y, 3M and 3C to emit lights at the corrected light emission amount so as to form the density correction pattern shown in FIG. 11. Further, the control unit 14 detects the density of the density correction pattern using the density sensor 39 (step S18).

Then, the control unit 14 determines whether the image density detected by the density sensor 39 is in a normal range which is set close to the target image density (step S19). When the control unit 14 determines that the detected image density is in the normal range (YES in step S19), the control unit 14 ends the density correction process.

When the control unit 14 determines that the detected image density is not in the normal range (NO in step S19), the control unit 14 performs an error processing (step S20). To be more specific, the control unit 14 changes the corrected developing voltage and the corrected light emission amount back to those before the density correction process, and displays an error message informing a user of a problem. Then, the control unit 14 ends the density correction process.

Figure 6:
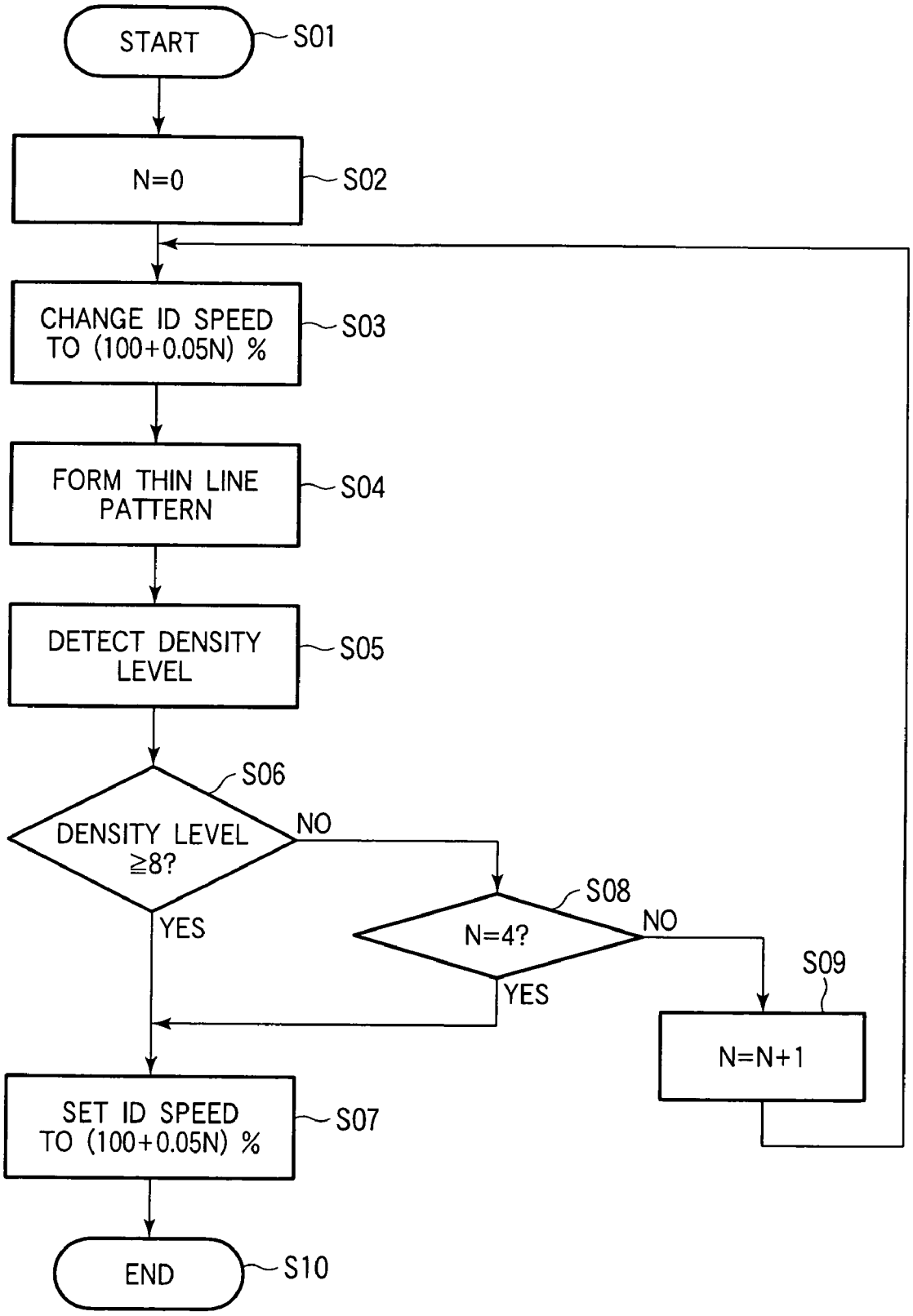
FIG. 6 is a flow chart showing the ID speed correction process based on the thin-line pattern according to the first embodiment of the present invention.
Figure 12:
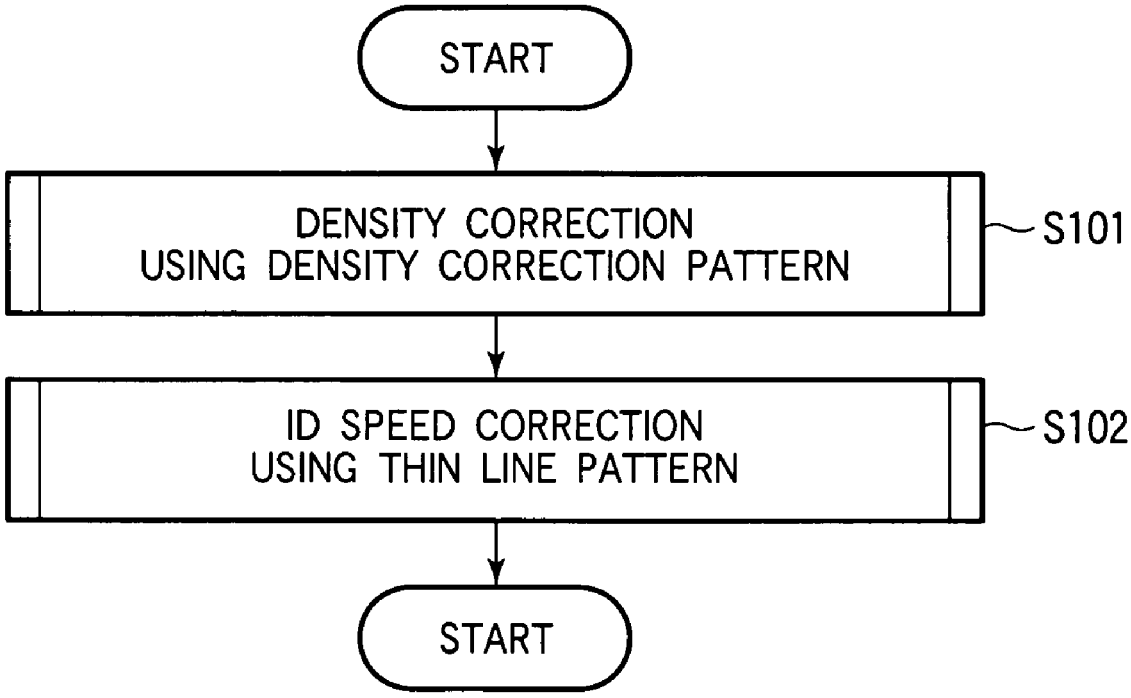
FIG. 12 is a flow chart showing a correction process according to the second embodiment of the present invention.

Further, as shown in FIG. 12, in the second embodiment, after the density correction process is completed (step S101), the ID speed correction process shown in FIG. 6 is performed (step S102). The ID speed correction process can be performed as described in the first embodiment with reference to FIG. 6 using the density sensor 39 instead of the CCD sensor 36.

As described above, according to the second embodiment of the present invention, the density correction is performed using the density correction pattern formed on the recording medium or the transferring belt. Therefore, in addition to advantages of the first embodiment, it becomes possible to effectively prevent the blurring of the thin lines and to consistently form excellent image regardless of time-dependent changes and environmental changes.

Although the above described first and second embodiments relate to the printer, the present invention is not limited to the printer, but is applicable to an image forming apparatus such as a copier, a facsimile machine, a multifunction peripheral (MFP) that forms an image using electrophotographic technique.

Further, in the case where the detection of the density level of the second embodiment is employed, the thin line pattern used in the ID speed correction process (described in the first embodiment) can be a pattern such that the thin lines are elongated laterally, obliquely or the like.

In the above described first and second embodiments, a direct transferring system (in which a developer image is directly transferred to a recording medium) is employed. However, it is also possible to employ an intermediate transferring system, and in such a case, the transfer belt 31 can be used as an intermediate transfer belt.

While the preferred embodiments of the present invention have been illustrated in detail, it should be apparent that modifications and improvements may be made to the invention without departing from the spirit and scope of the invention as described in the following claims.

What is claimed is:

1. An image forming apparatus comprising:

an image bearing body that is rotatably supported;

an exposing unit that irradiates said image bearing body to form a latent image;

a developer bearing body that develops said latent image using a developer to form a developer image;

a transfer unit that transfers said developer image to a recording medium;

a feeding unit that feeds said recording medium to a transferring position where said developer image is transferred to said recording medium;

a density detecting unit that detects a developer density of said developer image transferred to said recording medium, and a speed difference control unit that controls a difference of a circumferential speed of said image bearing body and a feeding speed of said recording medium fed by said feeding unit, wherein said speed difference control unit changes said difference of said circumferential speed of said image bearing body and said feeding speed of said recording medium based on a density of a thin line pattern transferred to said recording medium, the density of the thin line pattern being detected by said density detecting unit, and wherein said density detecting unit detects a developer density of a speed-difference-correction pattern image transferred to the recording medium, and also detects a developer density of a density-correction pattern image transferred to the recording medium.

2. The image forming apparatus according to claim 1, wherein said speed-difference-correction pattern image and said density-correction pattern image are mutually different patterns.

3. The image forming apparatus according to claim 2, wherein said speed-difference-correction pattern image includes a plurality of thin lines having predetermined widths, and wherein said density-correction pattern image includes a plurality of patch images having predetermined densities.

4. The image forming apparatus according to claim 3, further comprising:

a voltage applying unit for applying a predetermined developing voltage to said developer bearing body; and a density correction unit for correcting a developer density of said developer image formed on said image bearing body based on a detected developer density of said density-correction pattern image detected by said density detecting unit;

wherein said speed-difference-correction pattern image determines said difference of said circumferential speed of said image bearing body and said feeding speed of said recording medium based on a detected developer density of said speed-difference-correction pattern image detected by said density detecting unit after said density correction unit corrects said developer density of said developer image.

5. The image forming apparatus according to claim 4, wherein said density correction unit controls said voltage applying unit to correct said developing voltage, and then controls said exposing unit to correct light emission amount.

6. The image forming apparatus according to claim 5, wherein said speed difference control unit causes said density detecting unit to perform detection and calculates a density level based on a density result of said density detecting unit while changing said difference of said circumferential speed of said image bearing body and said feeding speed of said recording medium, until the calculated density level reaches a predetermined value.

7. The image forming apparatus according to claim 1, wherein said density detecting unit includes a CCD sensor.

8. The image forming apparatus according to claim 1, wherein said density detecting unit includes a density sensor.

9. The image forming apparatus according to claim 1, wherein said speed difference control unit controls said circumferential speed of said image bearing body.

10. An image forming apparatus comprising:

an image bearing body that is rotatably supported;

an exposing unit that irradiates said image bearing body to form a latent image;

a developer bearing body that develops said latent image using a developer to form a developer image;

a belt member that bears said developer image;

a belt driving unit that drives said belt member;

a density detecting unit that detects a developer density of said developer image on said belt member, and a speed difference control unit that controls a difference of a circumferential speed of said image bearing body and a driving speed of said belt member driven by said belt driving unit, wherein said speed difference control unit changes said difference of said circumferential speed of said image bearing body and said driving speed of said belt member based on a density of a thin line pattern on said belt member, the density of the thin line pattern being detected by said density detecting unit, and wherein said density detecting unit detects a developer density of a speed-difference-correction pattern image transferred to the belt member, and also detects a developer density of a density-correction pattern image transferred to the belt member.

11. The image forming apparatus according to claim 10, wherein said speed-difference-correction pattern image and said density-correction pattern image are mutually different patterns.

12. The image forming apparatus according to claim 11, wherein:

said speed-difference-correction pattern image includes a plurality of thin lines having predetermined widths; and said density-correction pattern image includes a plurality of patch images having predetermined densities.

13. The image forming apparatus according to claim 12, further comprising:

a voltage applying unit for applying a predetermined developing voltage to said developer bearing body; and a density correction unit for correcting a developer density of said developer image formed on said image bearing body based on a detected developer density of said density-correction pattern image detected by said density detecting unit;

wherein said speed-difference-correction pattern image determines said difference of said circumferential speed of said image bearing body and said driving speed of said belt member based on a detected developer density of said speed-difference-correction pattern image detected by said density detecting unit after said density correction unit corrects said developer density of said developer image.

14. The image forming apparatus according to claim 13, wherein said density correction unit controls said voltage applying unit to correct said developing voltage, and then controls said exposing unit to correct light emission amount.

15. The image forming apparatus according to claim 14, wherein said speed difference control unit causes said density detecting unit to perform detection and calculates a density level based on a density result of said density detecting unit while changing said difference of said circumferential speed of said image bearing body and said driving speed of said belt member, until the calculated density level reaches a predetermined value.

16. The image forming apparatus according to claim 10, wherein said density detecting unit includes a CCD sensor.

17. The image forming apparatus according to claim 10, wherein said density detecting unit includes a density sensor.

18. The image forming apparatus according to claim 10, wherein said speed difference control unit controls said circumferential speed of said image bearing body.

* * * * *